United States Patent [19]

Kreinin et al.

[11] 3,990,514

[45] Nov. 9, 1976

[54] METHOD OF CONNECTION OF WELLS

[76] Inventors: Efim Vulfovich Kreinin, Starye Kuzminki, 127a kvartal, 9b, kv. 69; Nikolai Ananievich Fedorov, B. Serpukhovskaya ulitsa, 31, korpus 5, kv. 198b; Roza Ivanovna Antonova, Chongarsky bulvar, 10, korpus 1, kv. 41; Alfei Fedorovich Volk, ulitsa Kropotkinskaya, 40, kv. 14; Elfrica Girshevna Gershevich, Sytinsky pereulok, 97/14, kv. 17, all of Moscow, U.S.S.R.

[22] Filed: June 11, 1975

[21] Appl. No.: 585,824

[30] Foreign Application Priority Data

June 12, 1974 U.S.S.R. ..... 2034166

[52] U.S. Cl. ..... 166/271; 166/259

[51] Int. Cl.[2] ..... E21B 43/24; E21B 43/26

[58] Field of Search ..... 166/271, 259, 305 R, 166/308

[56] References Cited

UNITED STATES PATENTS

| | | | |
|---|---|---|---|
| 2,914,304 | 11/1959 | Ljungström | 166/271 |
| 3,004,594 | 10/1961 | Crawford | 166/259 |
| 3,329,207 | 7/1967 | Shock et al. | 166/271 X |
| 3,709,295 | 1/1973 | Braunlich, Jr. et al. | 166/271 X |
| 3,775,073 | 11/1973 | Rhoades | 166/259 X |

*Primary Examiner*—Ernest R. Purser
*Assistant Examiner*—George A. Suckfield
*Attorney, Agent, or Firm*—Holman & Stern

[57] ABSTRACT

The method connecting wells by hydraulic-fracturing of a mineral bed, primarily for connection of wells in underground gasification of coal beds; using hydraulic-fracturing of a bed is effected intermediate a source-well into which a liquid is pumped under pressure and a well in the required direction; the head of the well with which connection is to be effected is sealed, whereas the heads of the wells, with which connection is undesirable, are opened; the liquid is pumped into the source-well under a pressure sufficient for initiating hydraulic-fracturing; the pressure in the well with which the source-well is to be connected is measured, and the moment the pressure in this well attains the hydraulic-fracturing value, the head thereof is immediately opened; upon the formation of a hydraulic fracturing fissure, the latter is flushed with the liquid; the method provides for building up a hydraulic-fracturing pressure in the well with which connection of the source-well is to be effected and thus controlling the direction of the formation of a hydraulic fracturing fissure.

2 Claims, 6 Drawing Figures

METHOD OF CONNECTION OF WELLS

FIELD OF THE INVENTION

The present invention relates to a method of connection of wells with each other by the method of hydraulic-fracturing of a mineral bed, e.g. coal, salt, sulphur or oil-bearing stratum.

BACKGROUND OF THE INVENTION

The invention can be employed to utmost advantage for connection of wells through the body of a coal bed in preparation of underground gas generators for underground gasification of coal fields.

Furthermore, the herein disclosed method of connection of wells can be utilized for increasing the water influx to the wells of water supply installations, as well as for lowering the water level in de-watering mineral deposits and also for water supply.

The disclosed method can likewise be employed for washout of underground salt deposits to create therein underground reservoirs for storage of crude oil, oil products and liquefied gases.

At present, the mineless method of gasification of coal beds is effected by means of wells drilled to the base of the coal bed. To perform gasification of the coal bed, the wells or boreholes thus drilled are connected through the coal bed so that upon connection of the wells throughout the entire extent of the coal bed there should be formed an area of increased permeability for the gaseous media employed for gasification and charged into the wells, i.e. the common unitary gasification channel. The gaseous media in most cases is either air or oxygen-enriched air.

According to one of the known methods of connection of wells, there is effected hydraulic-fracturing of the mineral bed intermediate the wells being connected.

Hydraulic-fracturing of mineral beds is widely utilized in development of oil fields, salt and sulphur fields, as well as at underground gasification of coal.

The technique of hydraulic fracturing of a mineral bed resides in that a liquid under high pressure is pumped into one of the wells which is often called in the art "the source-well", the liquid propagating through the coal bed via the system of natural fissures and pores.

The liquid pumped into the bed creates therein an area of increased pressure which tends to open and expand natural fissures in the bed, and this constitutes the hydraulic-fracturing and results in the creation of hydraulic-fracturing fissures. The hydraulic-fracturing of the bed takes place at a moment when the pressure of the liquid pumped into the bed exceeds the pressure of the overlying strata and the fracture strength of the coal bed. Owing to the formation of hydraulic-fracturing fissures the natural permeability of the bed is considerably increased.

The increased permeability of the bed in underground gasification enables an increase of the volume of gaseous agent pumped into the bed, which is necessary for carrying out the gasification process.

According to a hitherto known method of connection of wells by hydraulic-fracturing of the bed, a liquid is pumped into one of the drilled wells or boreholes, i.e. into the source-well under a pressure sufficient for initiating hydraulic-fracturing fissures, the other wells being left open, and the connection of the source-well being effected with one of the adjacent wells. Upon formation of a hydraulic fracturing fissure the latter is flushed with the liquid.

A shortcoming of the above specified known method is that it does not provide for directioning of the hydraulic fracturing.

This can be explained by the fact that hydraulic-fracturing fissures are formed predominantly in the direction of maximum natural permeability of the coal bed, which permeability is defined by the direction and dimensions of natural fissures in the coal bed. Therefore, more often than not there are formed short channels having arbitrary directions.

SUMMARY AND OBJECTS OF THE INVENTION

It is an object of the present invention to eliminate this shortcoming.

It is another object of the present invention to improve the quality of connection of wells by the technique of hydraulic-fracturing and to provide for forming hydraulic-fracturing fissures in a desired direction.

These objects are attained in a method of connection of wells for underground gasification through the body of a bed of mineral by hydraulic-fracturing of the bed, wherein the head of the well with which another well is to be connected is sealed; the heads of the wells with which connection is undesirable are opened; a liquid is pumped into said another well under a pressure exceeding the sum total of the pressure of the strata overlying said mineral bed and the fracture strength of said bed; the pressure in said well with which the connection of said another well is to be effected is measured, and the head of the said well is opened upon the pressure therein having attained the hydraulic-fracturing pressure value, within the shortest time possible; the pumping of the liquid into said another well is continued to flush and expand the hydraulic-fracturing fissure that has been formed in said bed of mineral.

It is expedient that following the flushing of the formed hydraulic-fracturing fissure, the latter should be purged with air under pressure.

The invention will be further described in connection with an exemplary embodiment thereof, with reference being had to the accompanying drawings, wherein:

DESCRIPTION OF A PREFERRED EMBODIMENT

Let us describe the utilization of the herein disclosed method for connection of wells intended for gasification of a coal bed.

Figure 1:
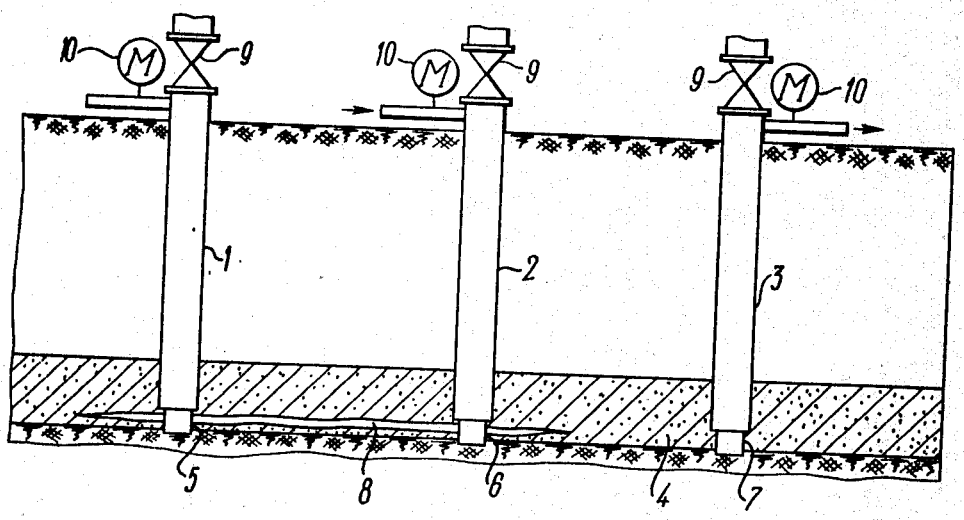
FIG. 1 illustrates schematically the wells connected by the hydraulic-fracturing technique.
Figure 2:
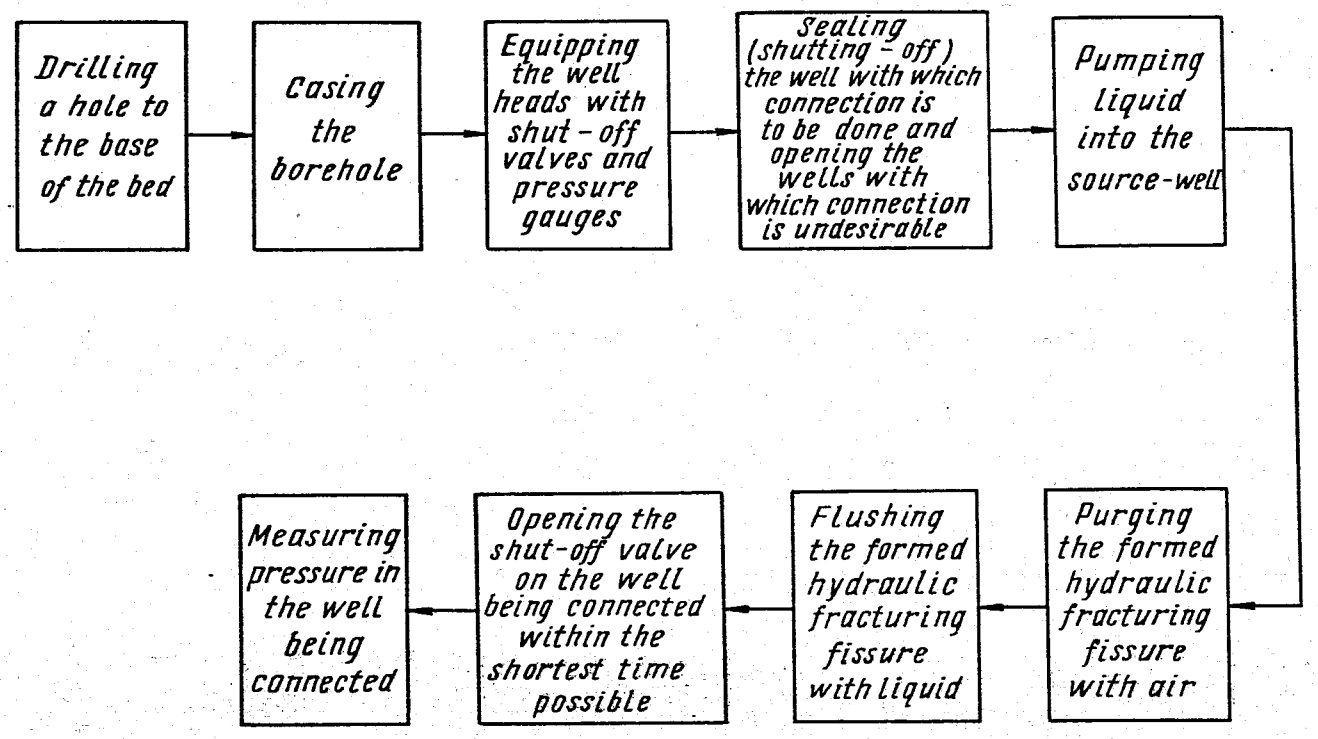
FIG. 2 is the flow chart of the disclosed method.

The herein disclosed method is effected as follows:

The wells or boreholes 1, 2 and 3 (FIG. 1) for underground gasification, which are to be connected by the technique of hydraulic-fracturing of the bed, are drilled to the base of a coal bed 4. The boreholes are cased with casing tubes.

The casing of the boreholes 1, 2 and 3 with the casing tubes is performed so that the portions 5, 6 and 7, respectively, thereof within the coal bed 4, adjacent to the base of the latter, should remain uncased in each one of the drilled holes 1, 2 and 3. The size of these uncased portions 5, 6 and 7 depends on the thickness of the coal bed and preferably is not less than one third of the thickness. On the other hand, it has been found expedient that this extent of an uncased portion should not exceed 2 meters from the base of the coal bed 4. The above prerequisites are necessary for the hydraulic-fracturing fissure 8 to be as close as possible to the base of the coal bed 4. Formation of a hydraulic-fracturing fissure 8 immediately adjacent the base of the coal bed 4 will subsequently pay off in complete gasification of the entire thickness of the coal bed 4. Should the hydraulic-fracturing fissure 8 be formed in the upper portion of the coal bed 4, the coal underlying this fissure 8 would remain ungasified.

The drilled holes 1, 2 and 3, i.e. the cased wells, form a portion of a gas generating system (not shown in the drawings) including a plurality of similar wells. For gasification purposes, a number of the wells are to be connected by the technique of hydraulic-fracturing of the bed. Thus, should it be necessary to connect, e.g. two wells 1 and 2, a liquid under high pressure is pumped into one of the wells, e.g. into the well 2. The well 2 into which the liquid is pumped will be hereinafter referred to as the source-well.

Prior to commencing the hydraulic-fracturing, the heads of the wells 1, 2 and 3 are equipped with shut-off valves 9 capable of sealing the wells 1, 2 and 3, respectively. Furthermore, the heads of these wells 1, 2 and 3 are equipped with pressure gauges 10 for measuring the pressure in the respective wells.

For effecting the hydraulic-fracturing of the bed 4, for instance, intermediate of the wells 1 and 2, the shut-off valve 9 at the well 1 is closed, to effect connection thereof with the source-well 2. On the adjacent wells with which such connection is undesirable, e.g. on the well 3, the respective shut-off valves are opened.

To form the hydraulic-fracturing fissure 8 in the coal bed 4, water is pumped under pressure into the source-well 2, this pressure being necessary to ensure hydraulic-fracturing of the coal bed 4 intermediate the wells 1 and 2 being connected. The pressure of the liquid pumped into the source-well 2 is selected depending upon the depth of occurrence of the coal bed 4, i.e. upon the pressure thereupon of the overlying strata, as well as upon the fracture strength of the coal bed 4.

Owing to the presence of the uncased portion 6 of the well 2 in the coal bed 4, the liquid being pumped into the source-well 2 starts propagating via a system of natural fissures, pores and cavities in the coal bed 4 in arbitrary directions. A portion of the liquid reaches the well 1, while another portion thereof reaches the well 3, some liquid that has reached the well 3 that had been left open starts flowing from this well. On the other hand, the liquid that has reached the sealed well 1 starts building up pressure in this well 1, the value of the pressure being indicated by the pressure gauge 10.

When the pressure in the well 1, with which connection by hydraulic-fracturing is to be attained, has reached the hydraulic-fracturing value, the well 1 is abruptly relieved; this is accomplished by opening, within the shortest time possible, i.e. instantly, the shut-off valve 9 at the head of the well 1. At the same time, pumping of the liquid into the source-well 2 is continued at a flow rate ensuring that the liquid carries therewith, to the surface, the pieces and lumps of coal that have been broken loose.

The abrupt and undelayed opening of the shut-off valve at the well 1, with which the source-well 2 is being connected, causes a sharp pressure drop, which results in a hydraulic shock taking place within the coal bed 4, the shock breaking up the coal in the formed hydraulic-fracturing fissure 8, whereby this fissure 8 is additionally expanded.

Thereafter, there is effected intense flushing of the fissure 8 with the liquid, which also results in its further expansion. The flushing of the hydraulic-fracturing fissure 8 should be sufficiently intense to ensure that the liquid carries the broken up coal to the surface. The flushing of the fissure 8 is continued until the fissure is expanded to a size ensuring that in the course of subsequent gasification it would enable to pass therethrough the air pumped into the well at a rate of 1000 to 2000 cu.m. per hour at a pressure of 2 to 5 atm. This flow capacity of the fissure 8 is essential for carrying out the process of gasification at a normal rate.

With the first pair of the wells 1 and 2 having been connected, there is commenced pumping of the liquid into the successive well with which a connection is to be made, e.g. into the well which thus becomes the source-well. The shut-off valve of the well with which the connection is to be made, e.g. of the well 2, is closed, while the valves at the adjacent wells (not shown in the drawing) are opened, whereafter the process is carried as it has been already described hereinabove. To prevent clogging of the fissure 8 already formed between the wells 1 and 2, air is pumped into the well 1 at a pressure short of that of the liquid being pumped-in.

The successive pair of the wells (not shown in the drawing) is connected in a manner similar to that described hereinabove. In this way there is formed a common unitary connection channel which is necessary for performing gasification.

Upon formation of the unitary connection channel, prior to commensing the gasification routine, the channel that has been formed is purged with air under pressure in excess of that of the water remaining in the coal bed. This purging also additionally expands the channel. The purging is performed by charging the air into the endmost one of the wells is interconnected by the channel, e.g. into the well 1, and letting it out from the other endmost well (not shown in the drawings) of the interconnected plurality, with the shut-off valves of the rest of the wells being closed.

Thus, sealing of the well with which the source-well is being connected and opening of other adjacent wells provides for building up of hydraulic-fracturing pressure in the sealed well and ensures that natural fissures in the coal bed are opened and expanded predominantly intermediate the source-well and the well being connected, which offers a means of controlling the direction of formation of the hydraulic-fracturing fissure.

Figure 3:
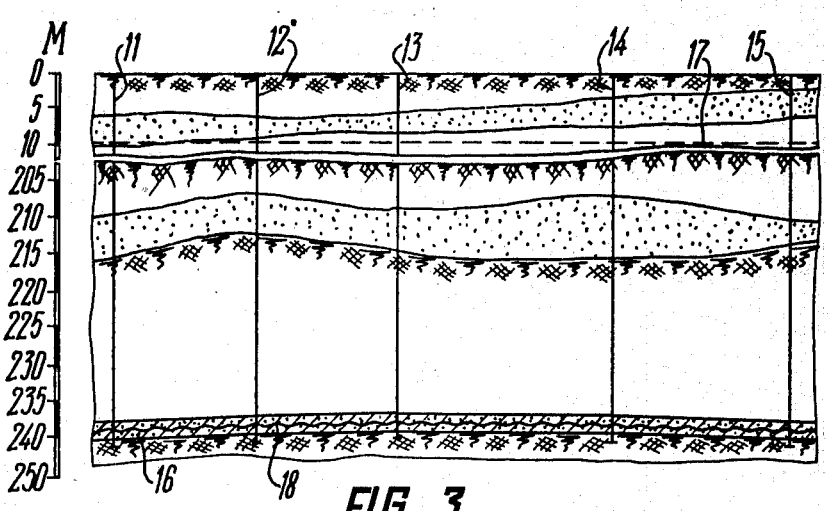
FIG. 3 is a vertical section through the wells 11 to 15.

As an example of practical application of the herein disclosed method, there will be described hereinbelow, a practical experience when connecting wells at a gas generating system such as that illustrated (FIG. 3).

The task was to connect the wells 11, 12, 13 and 14 with one another, the wells being arranged along the desired gasification channel at one zone of an underground gas generating facility.

All the wells were drilled to the base of the coal bed 16, to a depth of 235 to 238 m (refer to the Y-axis in FIG. 3) and were spaced from one another 20 to 30 m. The thickness of the coal bed 16 was 1.6 to 2.0 m. The coal bed 16 was inclined by 25° to 55° to the ground surface. The level 17 of subsoil water was at a 10 m depth.

Prior to performing the hydraulic-fracturing of the coal bed 16 under actual conditions, there was prepared an electric model for performing the hydraulic-fracturing between the wells 11 and 12, by the method of electrohydrodynamic analogy, with provisions for geometric similarity of the arrangement of the wells and of the boundary conditions.

Figure 4:
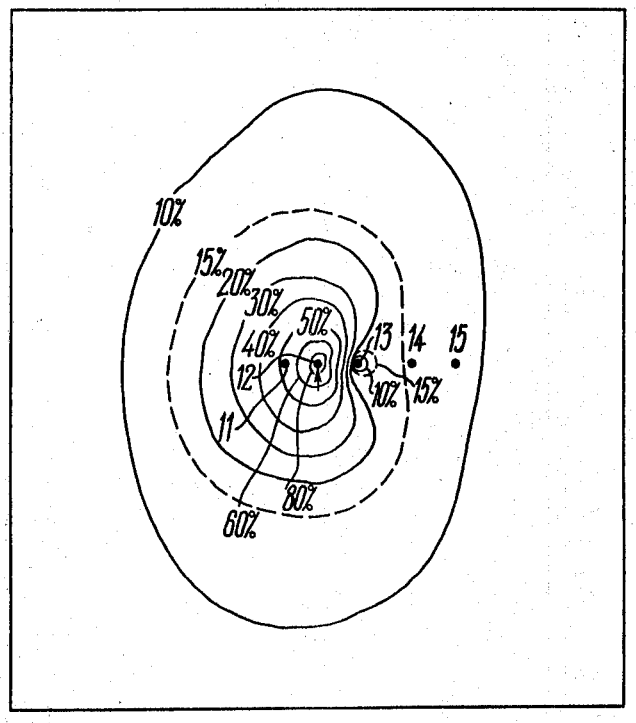
FIG. 4 illustrates the distribution of equipotential electric lines in an electric model, simulating the distribution of the heads of the subsoil water, as the liquid is pumped into the well 12.

The result of the electric simulation is illustrated in FIG. 4 where the curves show the distribution of electric equipotential lines simulating the heads of subsoil water during pumping of the liquid into the well 12. The numerals at the curve represent the values of electric potentials, per cent of the potential at the source-well 12.

In other words, the electric potential fed to the "source-well" is considered to be 100%, which simulates the maximum pressure value, i.e. the value of the pressure at the source-well.

Zero potential was applied to the well 13, to simulate the open well.

The electric simulation thus performed has shown that with the well 13 open and the well 11 sealed, the pumping pressure propagates in the coal bed 16 predominantly in the direction of the closed well 11 toward which the hydraulic-fracturing is to be performed, and that at the vicinity of this well 11 the pressure value is 50 to 60% of the required pumping pressure in the well 12, whereas in the vicinity of the well 13 the pressure would not rise above 10% of the same value.

With the depth of the coal bed 16 ranging from 235 m to 238 m and the fracture strength of the coal bed being of about 20 kg/cm², the hydraulic-fracturing pressure was to be 80 to 85 atm. at the well face, i.e. 60 to 65 atm. at at the well head.

Considering that in pumping the liquid into the bed about 60% of the head at the source-well is lost over the area between the wells, a somewhat higher pressure was set at the source-well, namely 100 to 110 atm.

Thus on the basis of the outcome of the electric simulation the pressure of the liquid pumped into the source-well 12 was specified to be 110 atm.

Figure 5:
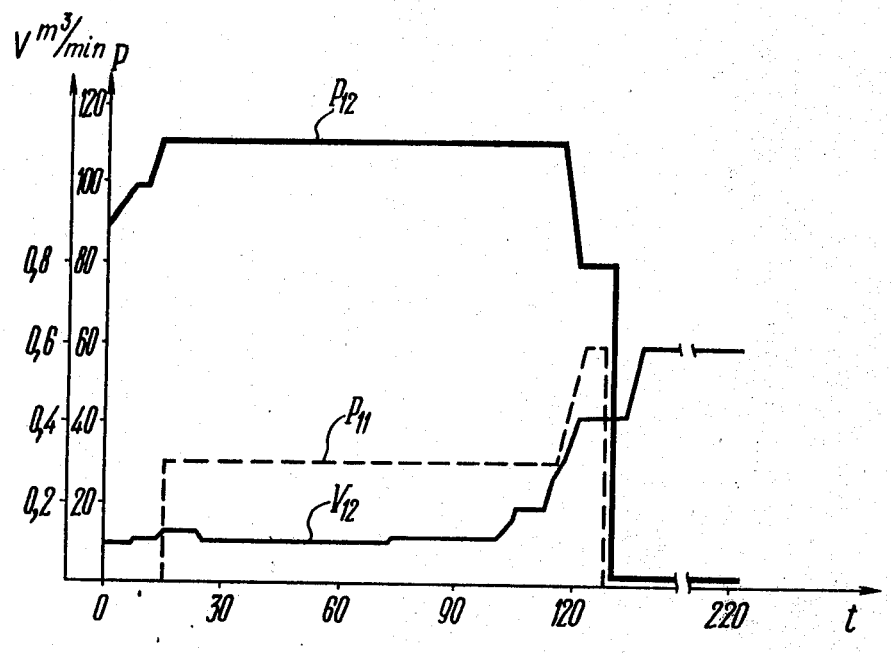
FIG. 5 shows the curves of variation of the pressure and flow rate of the liquid vs. time, as the liquid is pumped into the well 12.

To connect the first pair of the wells 11 and 12, the liquid was pumped into the well 12 at the pressure $P_{12}$ (FIG. 5) equalling 110 atm. gauge. The head of the well 11 with which the connection was to be established by hydraulic-fracturing was sealed, while the head of the well 13 with which the connection was undesirable was open. The pumping of the liquid was accomplished with the initial flow rate $V_{12}$ equalling 0.08 to 0.1 m³/min. Some of the liquid was flowing out from the open well 13.

In two hours from the moment of commencing the pumping of the liquid, the pressure $P_{12}$ in the well 12 dropped to 80 atm. gauge and at the same time the flow rate $V_{12}$ of the water rose to 0.4 m³/min. The pressure in the sealed well 11 increased to 60 atm. gauge.

These data indicated that hydraulic-fracturing of the coal bed 16 took place in the area between the wells 11 and 12, and a hydraulic-fracturing fissure 18 was formed.

When the pressure $P_{12}$ in the well 12 dropped to 80 atm. gauge, and the pressure in the well 11 increased to 60 atm. gauge, the well 11 was opened to communicate with the atmosphere.

Following the opening of the well 11, the pressure $P_{12}$ in the source-well 12 dropped to 1 atm. gauge, and the whole volume of the pumped-in water was flowing out of the well 11.

Then the hydraulic-fracturing fissure formed between the wells 11 and 12 was intensely flushed with water for 1 hour and 45 minutes.

in the course of this flushing, the water issuing from the well 11 carried therewith a great amount of coal pieces and lumps.

With the flushing completed, air under 28 atm. pressure was supplied into the well 12 to purge the formed fissure and to expand same.

Air blasting was continued until the well admitted an air flow of 4800 m³/hour.

Figure 6:
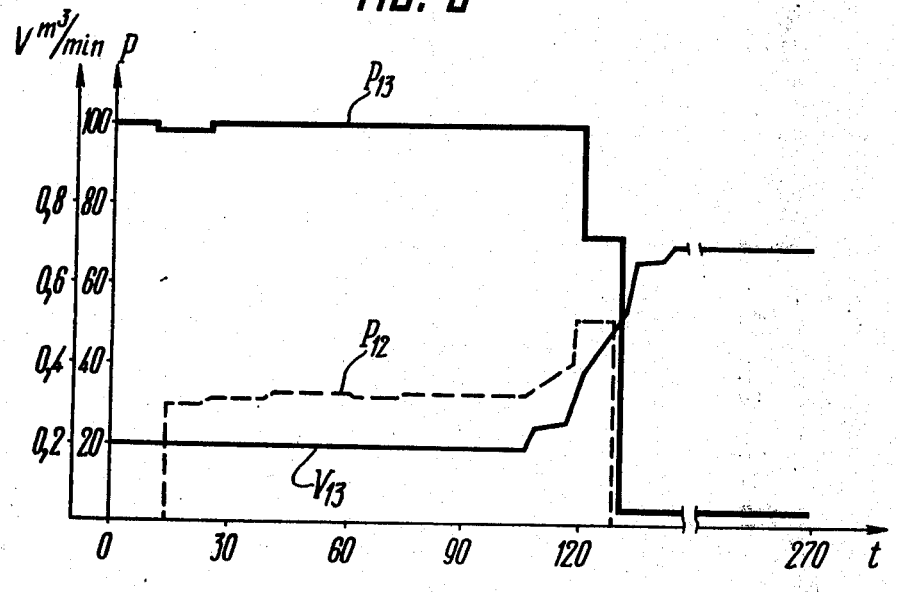
FIG. 6 shows the curves of variation of the pressure and flow rate of the liquid vs. time, as the liquid is pumped into the well 13.

To effect connection between the second pair of the wells 12 and 13, the liquid was subsequently pumped into the well 13 at a pressure $P_{13}$ of 100 atm. gauge (FIG. 6). For this period the well 12 was sealed, while water was supplied into the well 11 at a rate of 1.5 m³/min. to prevent clogging of the channel previously formed.

The pumping of the liquid into the well 13 to connect the latter with the well 12 was continued for 120 minutes at a pressure $P_{13}$ at the well head of 100 atm. gauge, with the flow rate $V_{13} = 0.2$ m³/min. After the 120 minutes, the pressure $P_{13}$ in the well 13 dropped to 76 atm. gauge, while in the well 12 the pressure $P_{12}$ increased to 35 atm. gauge and then to 56 atm. gauge, the flow rate $V_{13}$ of the pumped-in liquid rising first to 0.5 m³/min and subsequently to 0.7 m³/min.

The moment the pressure $P_{13}$ in the well 13 dropped to 76 atm. gauge and the pressure $P_{12}$ in the well 12 rose to 56 atm. gauge, the well 12 was opened into the atmosphere to let out the water carrying pieces of coal.

The liquid for flushing the fissure formed in the coal bed between the wells 12 and 13 was pumped for 2.5 hours. First, the channel between the wells 12 and 13 was flushed, whereafter the well 12 was shut-off, and the well 11 was opened to flush the entire portion of the connection channel between the wells 11 and 13.

Following the flushing, air under high pressure was directed into the well 13 to expand the hydraulic-fracturing fissure.

The remaining wells 14 and 15 were connected in pairs in a manner similar to that described hereinabove, which finally yielded a single unitary gasification channel throughout the entire portion of the underground gas generating system between the wells 11 and 15.

What we claim is:

1. A method of connection of wells for underground gasification by hydraulic fracturing of a mineral bed including: sealing off the head of the well with which another well is to be connected; opening the heads of the wells with which connection is undesirable; pumping a liquid into said other well at a pressure in excess of the sum total of the pressure of the strata overlying said bed and the fracture strength of said bed; measuring the pressure in said well with which the connection of said other well is to be effected and opening the head of said well the moment the pressure therein rises to the hydraulic-fracturing pressure value, within the shortest time possible; and continuing pumping the liquid into said other well to flush and to expand the hydraulic-fracturing fissure formed in said mineral bed.

2. A method as set forth in claim 1, including purging the said formed hydraulic-fracturing fissure with air under pressuring, following the flushing thereof with the liquid.

* * * * *